US007073278B2

(12) United States Patent
Cheng

(10) Patent No.: US 7,073,278 B2
(45) Date of Patent: Jul. 11, 2006

(54) INNER SOLE STRUCTURE

(75) Inventor: Sen-Mei Cheng, Changhua Hsien (TW)

(73) Assignee: Taiwan Paiho Limited, Changhua Hsien (TW)

( * ) Notice: Subject to any disclaimer, the term of this patent is extended or adjusted under 35 U.S.C. 154(b) by 167 days.

(21) Appl. No.: 10/885,581

(22) Filed: Jul. 8, 2004

(65) Prior Publication Data

US 2005/0262734 A1 Dec. 1, 2005

(30) Foreign Application Priority Data

May 28, 2004 (CN) ..... 93 2 08459

(51) Int. Cl.
*A43B 13/38* (2006.01)

(52) U.S. Cl. ..... 36/43; 36/44; 36/141; 36/11.5

(58) Field of Classification Search ..... 36/43, 36/44, 141, 11.5
See application file for complete search history.

(56) References Cited

U.S. PATENT DOCUMENTS 3,059,350 A * 10/1962 Price ..... 36/11.5
4,509,510 A * 4/1985 Hook ..... 601/28
4,575,954 A * 3/1986 Bye ..... 36/89
6,219,941 B1 * 4/2001 Kukoff ..... 36/44
6,817,113 B1 * 11/2004 Pan ..... 36/11.5
2003/0208924 A1 * 11/2003 Pan ..... 36/11.5
2004/0118015 A1 * 6/2004 Lai ..... 36/3 B

FOREIGN PATENT DOCUMENTS

CH 636507 A5 * 6/1983

* cited by examiner

*Primary Examiner*—Ted Kavanaugh
(74) *Attorney, Agent, or Firm*—Troxell Law Office, PLLC

(57) ABSTRACT

An inner sole structure includes an insole integrally woven to form a plurality of resilient areas with supporting hoops and buffer areas without the supporting hoops thereof defining the upper surface thereon wherein the resilient and the buffer areas thereof can be made in any shapes like rectangles, triangles, or tilted stripes and be alternatively interrelated in regular or irregular arrangement thereof. The supporting hoops thereof are stood upright with vents defined therein and dividing passages formed at the adjacent sides thereof, and a coupling facet is disposed at the bottom side of the insole thereon to be integrally combined with a loading pad via thermal pressure operation to generate heat welding thereby. Thus, the resilient areas with the supporting hoops of a proper hardness can flexibly sustain the sole of a human foot stepped downwards thereon, stimulating blood circulation and providing a better massage effect. Besides, via the buffer areas alternatively arranged with the resilient areas thereof, the sole of the foot is partially suspended above the insole thereof, providing more proper and ventilating airy space there-between without the foot stuck stuffily and completely onto the insole thereof so as to keep the hygiene of the foot thereof.

7 Claims, 8 Drawing Sheets

INNER SOLE STRUCTURE

BACKGROUND OF THE INVENTION

The present invention is related to an inner sole structure, including an insole integrally woven to form a plurality of resilient areas with supporting hoops and buffer areas without the supporting hoops thereof defining the upper surface thereon wherein the resilient and the buffer areas thereof can be made in any shapes and alternatively interrelated in regular or irregular arrangement, and the supporting hoops thereof are stood upright with vents defined therein and dividing passages formed at every adjacent sides thereof; whereby, the resilient areas with the supporting hoops of proper hardness can flexibly sustain the sole of a human foot stepped downwards thereon, stimulating blood circulation and providing a better massage effect, and the buffer areas alternatively arranged with the resilient areas thereof can suspend the sole of the foot partially above the insole thereof, providing more proper and ventilating airy space without the foot stuffily stuck completely onto the insole thereof so as to keep the hygiene of the foot thereof.

Please refer to FIGS. 1 to 2 inclusive. A conventional inner sole structure includes an insole 10 properly cut in conformance to the shape of a shoe to form a flat piece with a proper thickness that is further put inside the shoe in direct contact with the sole of a human foot stepped flatly downwards thereon as shown in FIG. 2.

There are some drawbacks to such conventional insole 10. First, the insole 10, made into a flat thin piece, is fully contacted with the sole of the foot without any flexibility to suit different wearers, which are quite uncomfortable to the wearer in use. Second, the sole of the foot is directly applied onto the insole 10 as a whole without any airy and ventilating space left there-between. Thus, moisture or heat generated by the sole of the foot tends to stick stuffily onto the insole 10, and bad smell of the foot can easily emit there-from after a certain period of time, which is quite unhygienic to the foot of the wearer thereof. Third, the insole 10 is molded with a flat surface that is unable to flexibly sustain the sole of the foot and produce any massage effect to stimulate the circulation of the blood in practical use. Thus, the foot of the wearer can easily get sore or pains after long time of walking and wrapped at the shoe 20 therein, which greatly reduces the function of the insole 10 thereof.

SUMMARY OF THE PRESENT INVENTION

It is, therefore, the primary purpose of the present invention to provide an inner sole structure, including an insole integrally woven to form a plurality of resilient areas with supporting hoops and buffer areas without the supporting hoops thereof defining the upper surface thereon wherein the resilient areas and the buffer areas thereof are alternatively interrelated and individually arranged in regular or irregular manner, which can efficiently reduce the contact area between the sole of a foot and the insole thereof. Besides, the resilient areas with the supporting hoops of proper hardness can flexibly sustain the sole of the foot stepped downwards thereon, stimulating blood circulation and providing a better massage effect to boost the function of the insole thereof.

It is, therefore, the second purpose of the present invention to provide an inner sole structure wherein the supporting hoops of the resilient areas thereof are stood upright with vents defined therein and dividing passages formed at every adjacent sides thereof to provide better airy capability of the insole thereof, and the buffer areas alternatively arranged with the resilient areas thereof can suspend the sole of the foot partially above the insole thereof to provide more proper and ventilating airy space there-between without the foot stuck stuffily and completely onto the insole thereof so as to keep the hygiene of the foot thereof.

It is, therefore, the third purpose of the present invention to provide an inner sole structure wherein the insole can also have bamboo charcoal contained therein, providing the insole thereof with strong absorbing and decomposing capabilities as well as anti-bacteria, humid-adjustment, and deodorization power. Besides, far-infrared radiation proper for the absorption of human body is generated to speed up blood circulation and improve the health of human body, and healthy negative ions is increased in the air to balance the humidity inside the shoe and prevent bugs therein, efficiently promoting the quality of the shoe to achieve better deodorization and anti-bacteria effects.

It is, therefore, the fourth purpose of the present invention to provide an inner sole structure wherein the insole thereof is integrally combined with a loading pad that is properly cut into form conforming to that of the sole of the foot and has an abutting base disposed at the bottom side thereon so as to provide an anti-slippery effect thereby.

DETAILED DESCRIPTION OF THE PREFERRED EMBODIMENTS

Figure 1:
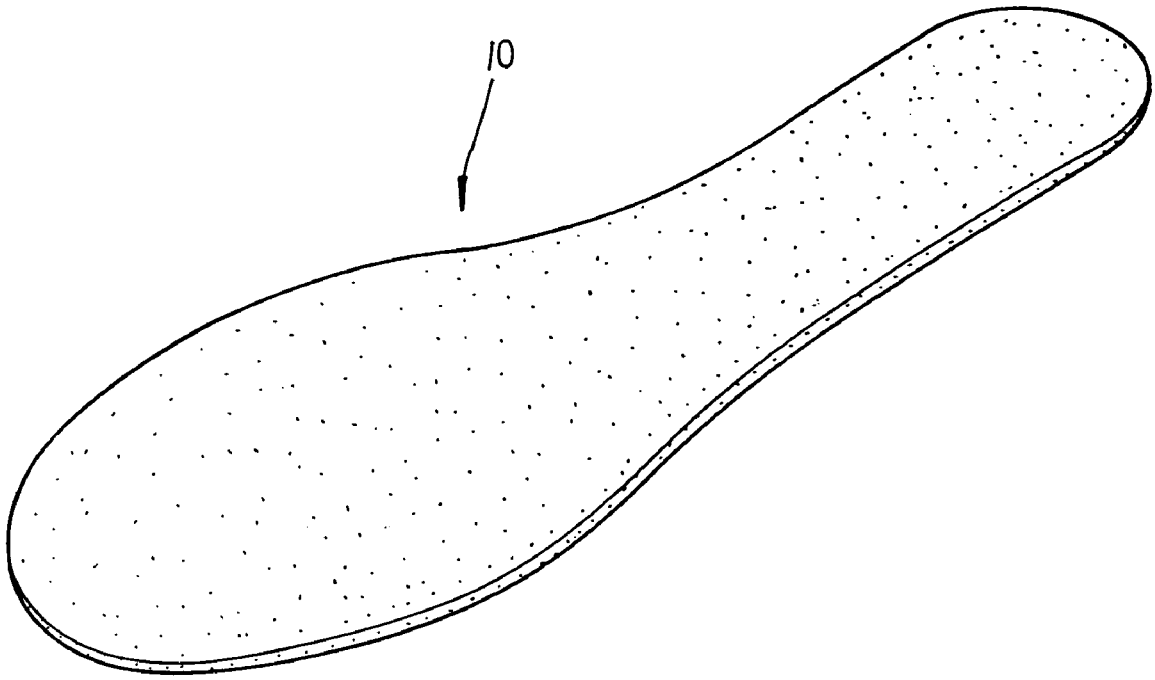
FIG. 1 PRIOR ART
FIG. 1 is a perspective view of a conventional insole structure.
Figure 2:
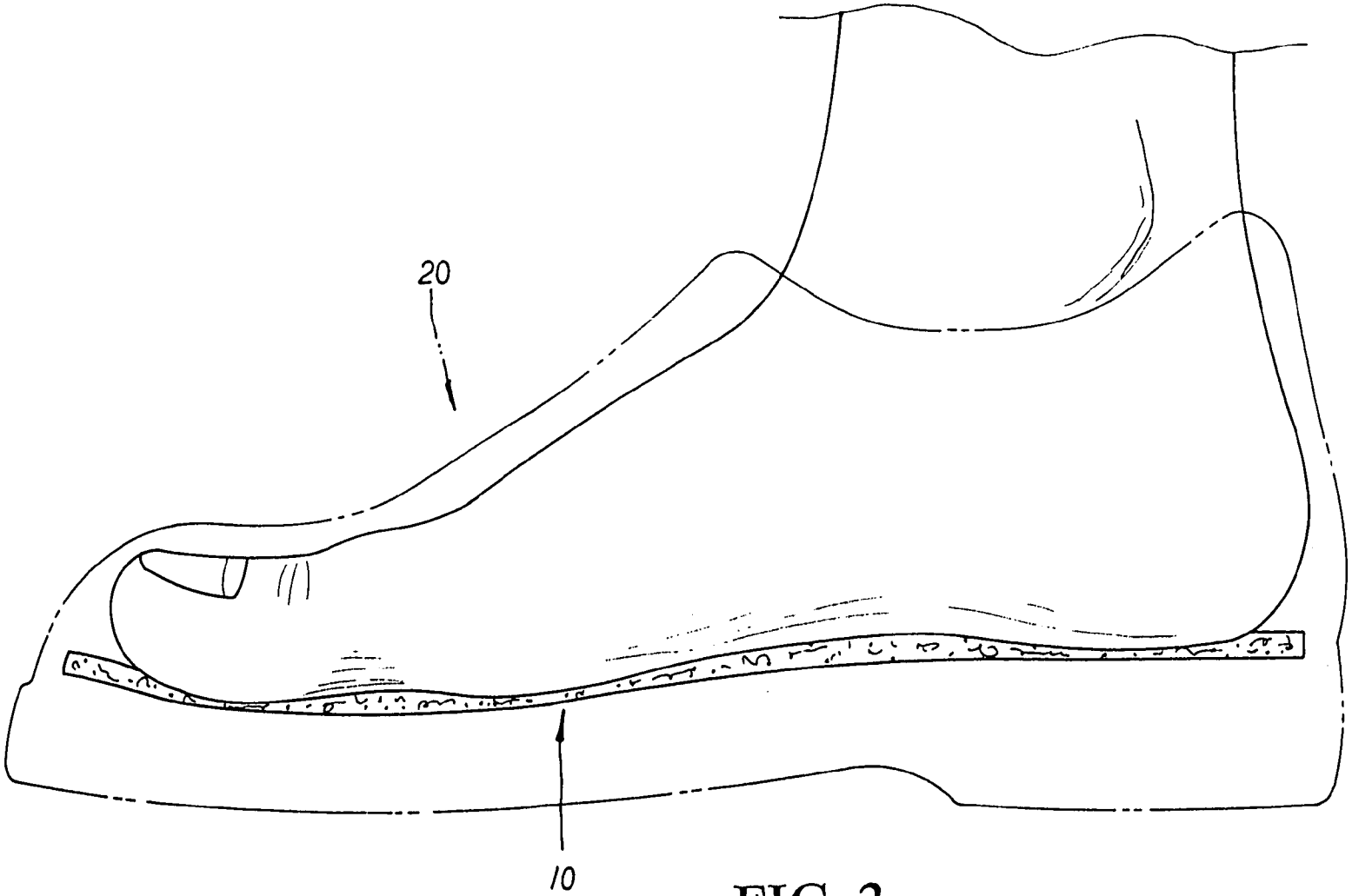
FIG. 2 PRIOR ART
FIG. 2 is a diagram showing an insole of the conventional insole structure in use.
Figure 3:
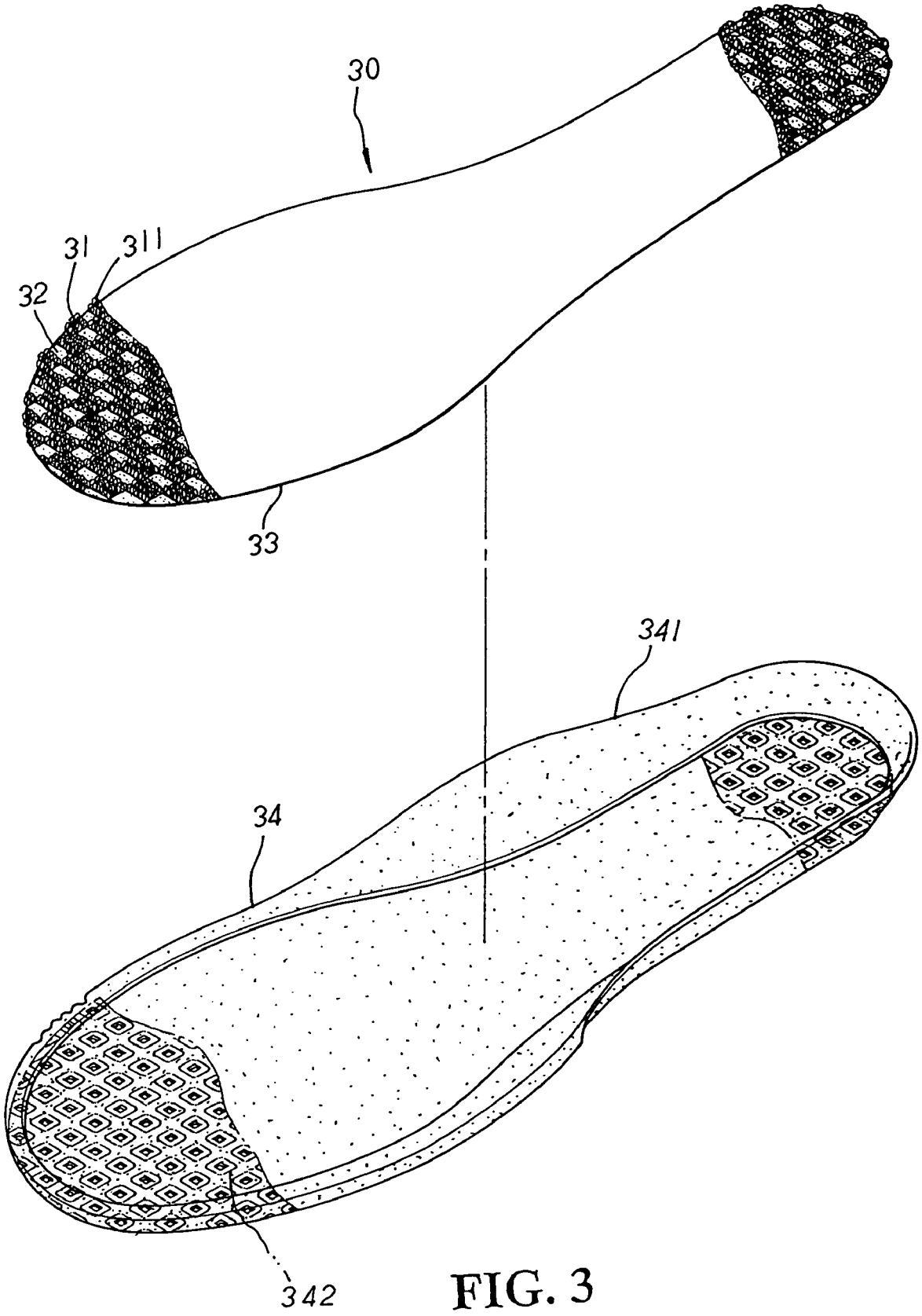
FIG. 3 is a perspective exploded view of the present invention.
Figure 4:
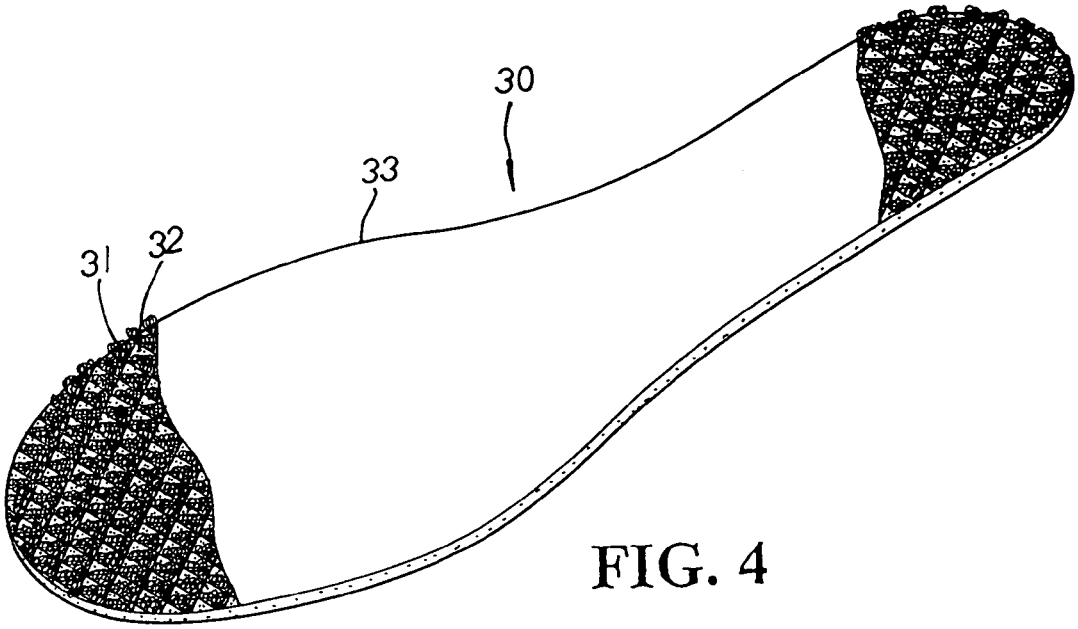
FIG. 4 is a perspective view of another embodiment of an insole of the present invention.
Figure 5:
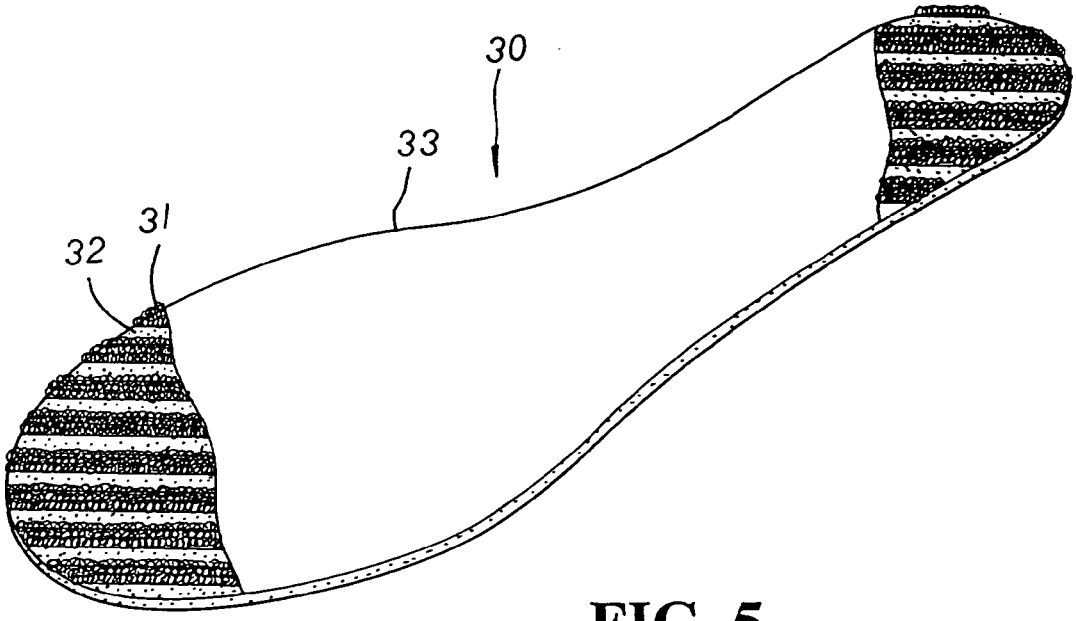
FIG. 5 is a perspective view of a third embodiment of the insole of the present invention.
Figure 6:
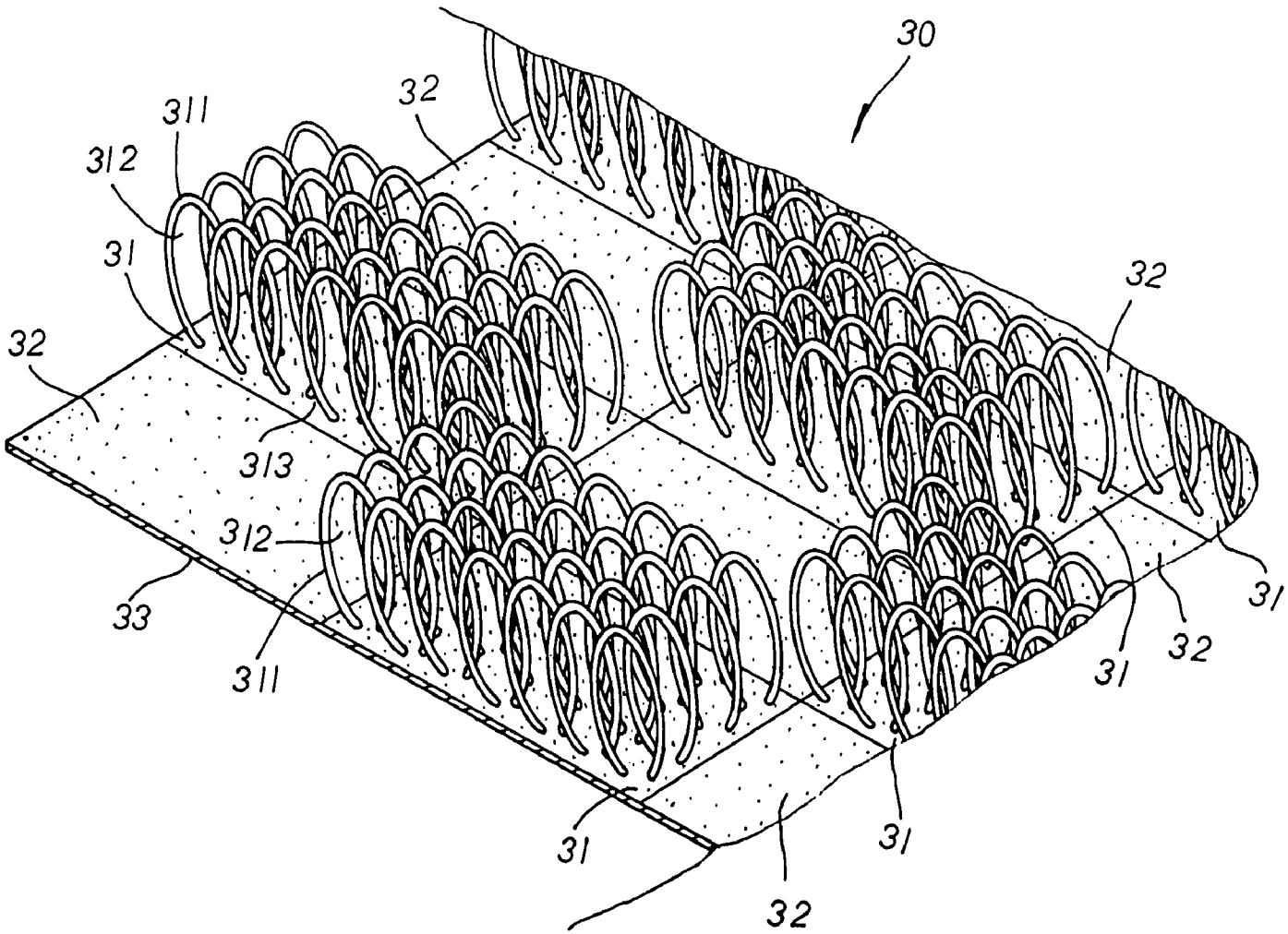
FIG. 6 is a partially enlarged and perspective sectional view of the present invention.
Figure 7:
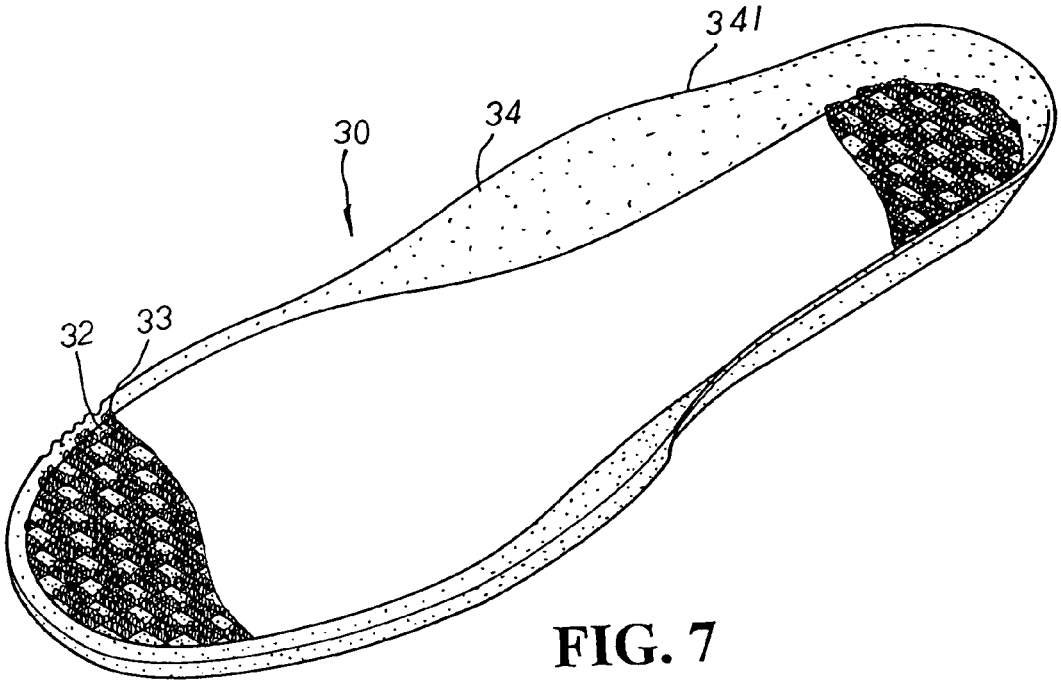
FIG. 7 is a perspective view of the present invention in assembly.

Please refer to FIGS. 3 to 7 inclusive. The present invention is related to an inner sole structure, including an insole 30 that, having bamboo charcoal contained therein, is integrally woven to form a plurality of resilient areas 31 with supporting hoops 311 and buffer areas 32 without the supporting hoops 311 thereof defining the upper surface thereon. The resilient areas 31 and the buffer areas 32 thereof can be made in any shapes such as rectangles or triangles as shown in FIG. 4, or tilted stripes as shown in FIG. 5, and are alternatively interrelated in regular or irregular arrangement thereof. The supporting hoops 311 as shown in FIG. 6 are stood upright with vents 312 defined therein and dividing passages 313 formed at the adjacent sides thereof. The insole 30 also has a coupling facet 33 disposed at the bottom side thereon to be integrally combined with a loading pad 34 of EVA or PVC foaming material via thermal-pressurized operation to generate heat welding thereof as shown in FIG. 7. At the top side of the loading pad 34 is disposed a supporting edge 341 defining the rear periphery thereof in conformance to the shape of a human foot, and at the bottom side thereof is equipped with an abutting base 342 having a plurality of protruded and indented pieces of various shapes distributed thereon to provide anti-slippery effect for stable location thereby. Besides, the supporting hoops 311 of the resilient areas 31 are made of fibers With a proper hardness for massage effect thereof.

Figure 8:
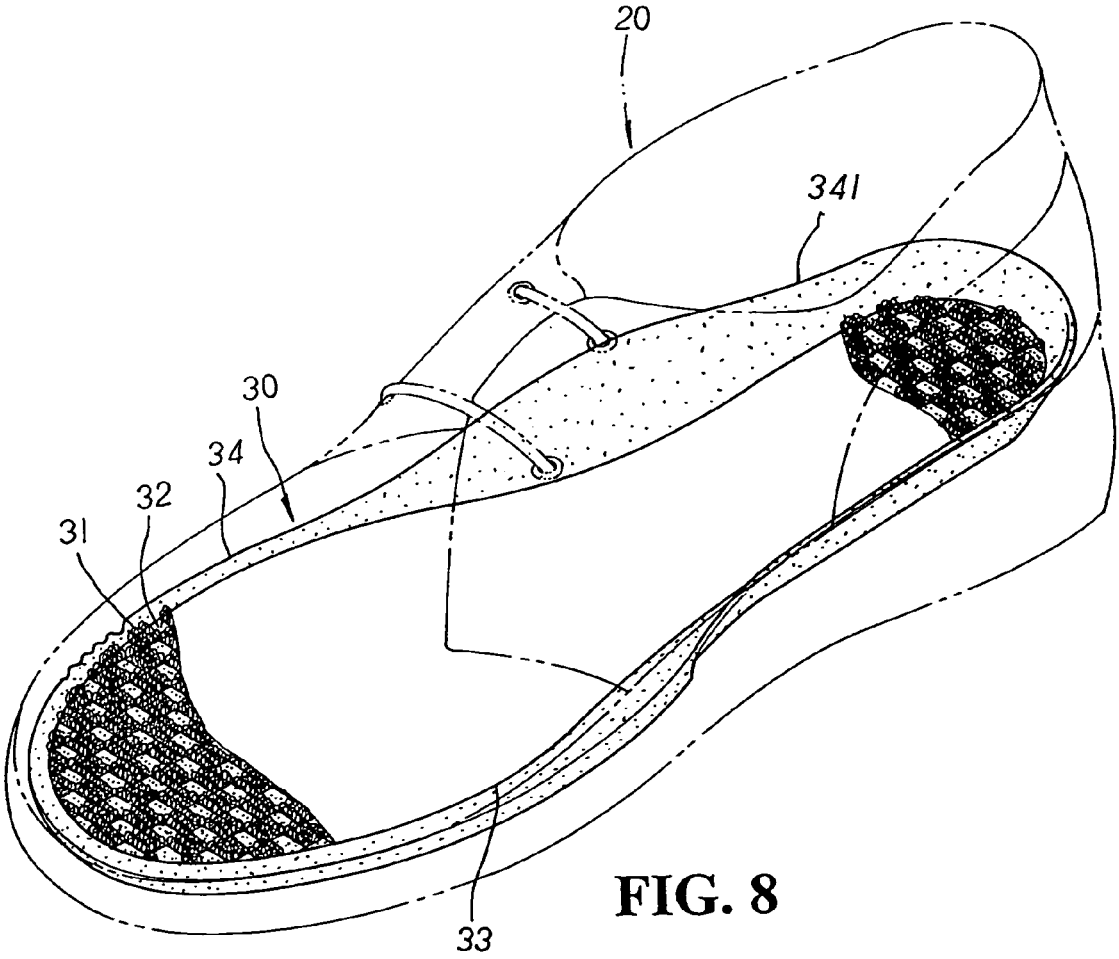
FIG. 8 is a diagram showing the present invention in practical use.
Figure 9:
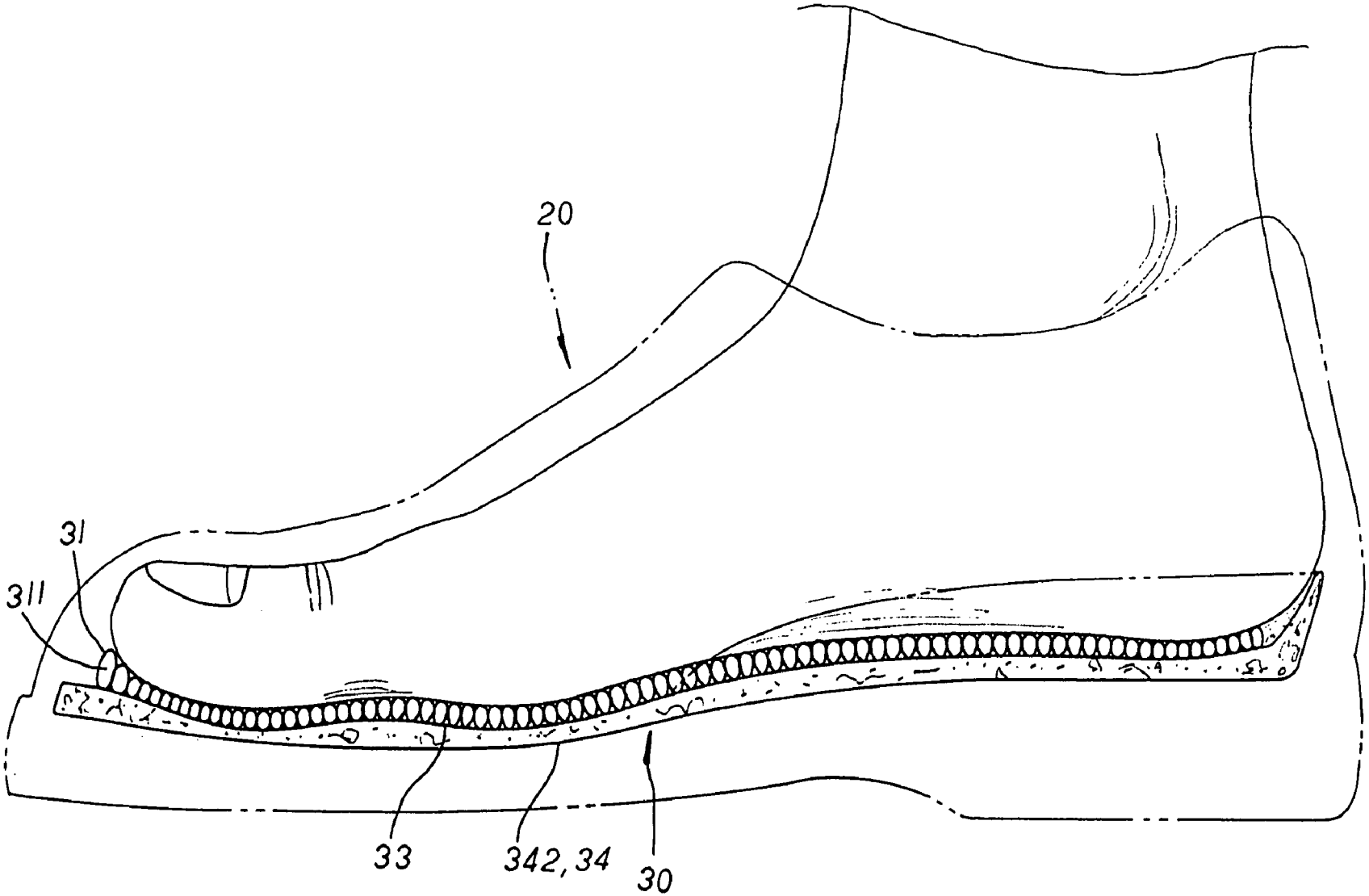
FIG. 9 is a diagram showing the insole of the present invention stepped downwards by the sole of a foot in practical use.

Please refer to FIGS. 8 to 9 inclusive. In practical use, the insole 30 is directly put inside a shoe 20. Via the resilient areas 31 with the supporting hoops 311 alternatively interrelated to the buffer areas 32 without the supporting hoops 311 thereof in arrangement at the upper surface of the insole 30 thereon, the supporting hoops 311 with a proper hardness can flexibly sustain the sole of a foot stepped downwards onto the resilient areas 31 as shown in FIG. 9, stimulating blood circulation and providing a better massage effect. And via the vents 312 formed at the supporting hoops 311 therein and the dividing passages 313 defining every adjacent sides of the supporting hoops 311 thereof, the insole 30 is also equipped with a better ventilating capability. Besides, the resilient areas 31 thereof are individually arranged relative to the buffer areas 32 without the supporting hoops 311 distributed thereon, permitting the sole of the foot to suspend partially above the insole 30 thereof and providing more ventilating airy space there-between without the foot stuck stuffily and completely onto the insole 30 thereof so as to keep the hygiene of the foot thereof. And via the bamboo charcoal contained therein, the insole 30 thereof is also equipped with strong absorbing and decomposing capabilities as well as anti-bacteria, humid-adjustment, and deodorization power. Far-infrared radiation proper for the absorption of human body can also be generated by the bamboo charcoal contained at the insole 30 to speed up blood circulation and improve the health of human body, and healthy negative ions is increased in the air to balance the humidity inside the shoe and prevent bugs therein, efficiently promoting the quality of the shoe 20 thereof to achieve better deodorization and anti-bacteria effects thereof.

Figure 10:
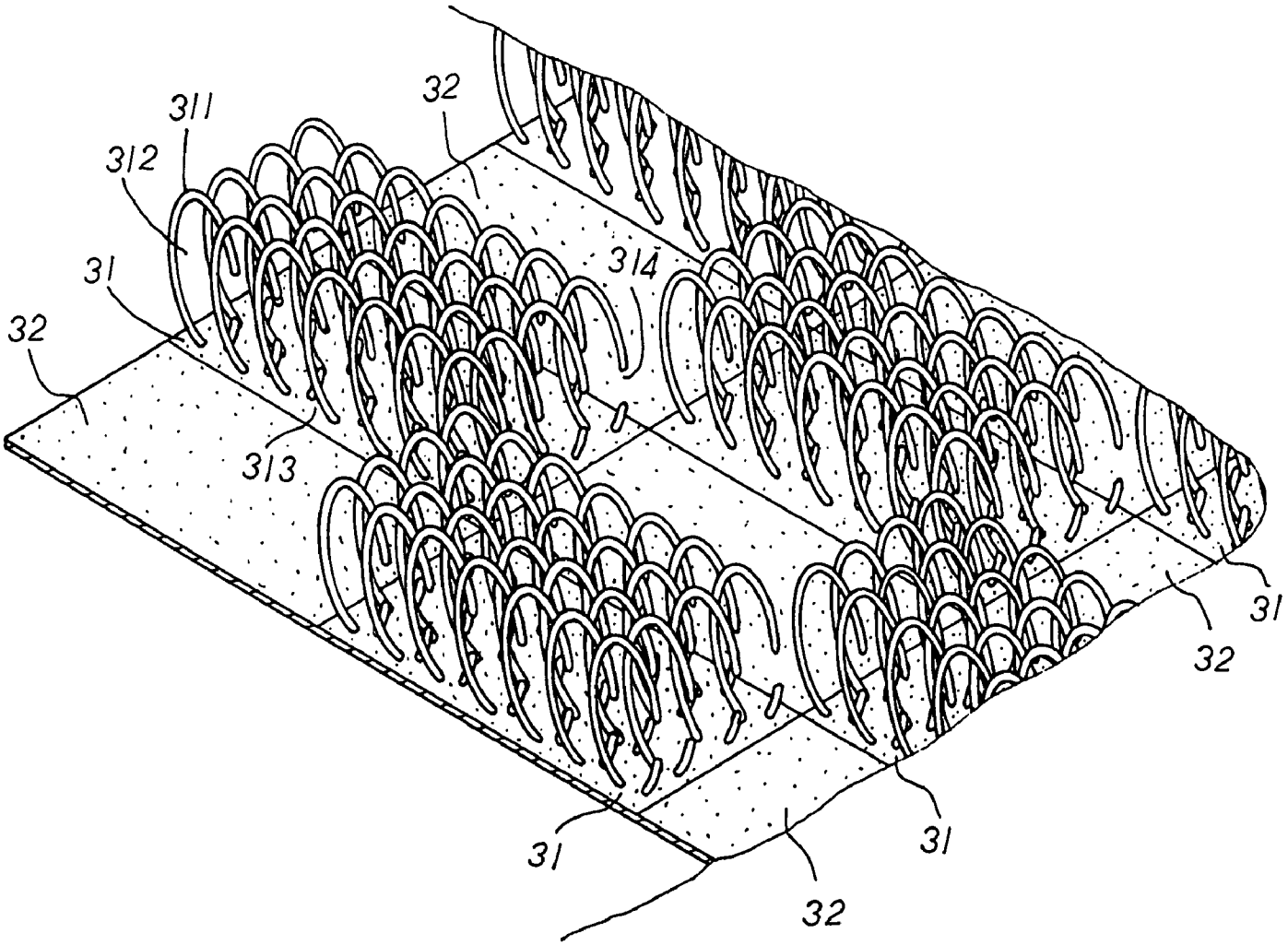
FIG. 10 is a partially enlarged and perspective sectional view of a fourth embodiment of the present invention.

Please refer to FIG. 10. The supporting hoops 311 of the resilient areas 31 can also have openings 314 properly cut at preset spots thereon.

What is claimed is:

1. An inner sole structure, including an insole integrally woven to form a plurality of resilient areas with supporting hoops and buffer areas without the supporting hoops thereof defining the upper surface thereon wherein the resilient areas and the buffer areas thereof are alternatively interrelated in arrangement, the supporting hoops are stood upright with vents defined therein and dividing passages formed at the adjacent sides thereof; a coupling facet is disposed at the bottom side of the insole thereon to be integrally combined with a loading pad via thermal pressure operation thereby; thus, the resilient areas with the supporting hoops of a proper hardness can flexibly sustain the sole of a human foot stepped downwards thereon, stimulating blood circulation and providing a better massage effect; besides, via the buffer areas alternatively arranged with the resilient areas thereof, the sole of the foot is partially suspended above the insole thereof, providing more proper and ventilating airy space there-between without the foot stuck stuffily and completely onto the insole thereof so as to keep the hygiene of the foot thereof.

2. The inner sole structure as claimed in claim 1 wherein the resilient areas and the buffer areas thereof can be formed in any shapes and arranged in regular or irregular manner.

3. The inner sole structure as claimed in claim 1 wherein the resilient areas and the buffer areas thereof can be made in shapes like rectangles, triangles, or tilted stripes, etc.

4. The inner sole structure as claimed in claim 1 wherein the supporting hoops of the resilient areas can be made of fiber material.

5. The inner sole structure as claimed in claim 1 wherein the loading pad thereof are better made of EVA or PVC foaming material.

6. The inner sole structure as claimed in claim 1 wherein the insole thereof can also have bamboo charcoal contained therein to achieve deodorization and anti-bacteria effects thereof.

7. The inner sole structure as claimed in claim 1 wherein the supporting hoops of the resilient areas thereof can also have openings properly cut at preset spots thereon.

* * * * *